US008671506B2

(12) United States Patent
Steckmann et al.

(10) Patent No.: US 8,671,506 B2
(45) Date of Patent: Mar. 18, 2014

(54) WASHING DEVICE

(75) Inventors: Helge Steckmann, Grävenwiesbach-Hundstadt (DE); Irina Karpel, Bad Nauheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 782 days.

(21) Appl. No.: 12/758,425

(22) Filed: Apr. 12, 2010

(65) Prior Publication Data

US 2010/0269274 A1 Oct. 28, 2010

(30) Foreign Application Priority Data

Apr. 23, 2009 (DE) ..... 10 2009 018 580

(51) Int. Cl.
*B21B 45/02* (2006.01)

(52) U.S. Cl.
USPC ..... 15/256.51; 101/425

(58) Field of Classification Search
USPC ..... 15/256.51, 256.5, 97.1, 98; 101/423, 101/167, 169, 350.3, 425, 424; 162/280–281, 199, 198, 174; 118/413
See application file for complete search history.

(56) References Cited

U.S. PATENT DOCUMENTS

| | | | | |
|---|---|---|---|---|
| 4,991,507 | A * | 2/1991 | Nozaka et al. | 101/425 |
| 5,117,751 | A | 6/1992 | Thompson | |
| 6,638,363 | B2 * | 10/2003 | Erdmann | 134/9 |
| 6,752,077 | B2 * | 6/2004 | Kolbe et al. | 101/169 |
| 6,861,195 | B2 | 3/2005 | Oshiba et al. | |
| 6,865,986 | B2 | 3/2005 | Link | |
| 2003/0213386 | A1 | 11/2003 | Kolbe et al. | |
| 2004/0141771 | A1 * | 7/2004 | Oshiba et al. | 399/159 |
| 2009/0007810 | A1 * | 1/2009 | Raasch et al. | 101/423 |

FOREIGN PATENT DOCUMENTS

| | | | |
|---|---|---|---|
| DE | 42 13 636 | A1 | 10/1992 |
| DE | 197 32 060 | A1 | 1/1999 |
| DE | 199 02 957 | A1 | 8/2000 |
| DE | 100 63 987 | A1 | 7/2002 |
| DE | 10 2007 030 572 | A1 | 1/2009 |
| EP | 0364901 | A2 | 4/1990 |
| GB | 2 346 113 | A | 8/2000 |
| JP | 11-070641 | A | 3/1999 |
| WO | 03/011599 | A1 | 2/2003 |

OTHER PUBLICATIONS

German Patent and Trademark Office Search Report, dated Nov. 18, 2009.

* cited by examiner

*Primary Examiner* — Robyn Doan
*Assistant Examiner* — Brianne Kalach
(74) *Attorney, Agent, or Firm* — Laurence A. Greenberg; Werner H. Stemer; Ralph E. Locher

(57) ABSTRACT

A washing device has a washing cloth for removing contaminants, ink, etc. from a surface and an ultrasound device for assisting a cleaning operation. The washing device includes one or more ultrasound generators and one or more resonators each in the form of an oscillating flat metal body, from which sound energy is output onto a substantially linear region on the surface to be cleaned.

19 Claims, 6 Drawing Sheets

WASHING DEVICE

CROSS-REFERENCE TO RELATED APPLICATION

This application claims the priority, under 35 U.S.C. §119, of German Patent Application DE 10 2009 018 580.1, filed Apr. 23, 2009; the prior application is herewith incorporated by reference in its entirety.

BACKGROUND OF THE INVENTION

Field of the Invention

The invention relates to a washing device, preferably for a cylinder in a printing press, having a washing cloth and an ultrasound device for assisting a cleaning operation.

Such a washing device is known, for example, from International Publication No. WO 03/011599. There, an ultrasound source is provided for assisting a washing operation. The ultrasound source is to serve for more readily removing contaminants, ink, etc. from a surface of a rubber blanket which is clamped onto a transfer cylinder in an offset printing press. Furthermore, German Published, Non-Prosecuted Patent Application DE 100 63 987 A1, corresponding to U.S. Pat. No. 6,865,986, describes a cloth washing device for a digital printing press. There, in order to clean a cylinder which carries a printing image, a cleaning belt which is impregnated with a liquid can be loaded on the cylinder surface with an ultrasound actuator. Moreover, German Published, Non-Prosecuted Patent Application DE 197 32 060 A1 describes a washing device for the blanket cylinder of an offset printing press which has an ultrasound generator but no washing cloth. In that case, released dirt particles are to be doctored from the cylinder surface by rubber lips.

Japanese Patent Publication JP 11-70641 describes the use of a washing doctor which vibrates in the ultrasound range and is in direct mechanical contact with the rubber surface. In apparatuses of that type, there is a risk that the cleaning liquid which is sprayed onto the rubber blanket in front of the doctor passes into the printing press and causes damage there by corrosion, etc.

So-called cloth washing devices, which have previously been used in offset printing presses, and in which the inked printing blanket is cleaned on the transfer cylinder in the case of a job change, usually do not have any ultrasound sources for assisting the cleaning operation. Even without assistance of that type, the washing time is approximately 2 minutes with the rubber blanket being washed clean within approximately 10 cylinder revolutions. Nevertheless, there is the desire to further shorten the washing times, in the sense of a rapid job change. However, that was not possible with the ultrasound washing devices which are described in the prior art. Its realization failed because of the fact that the proposed units had too high a power requirement. That is because, in order to achieve the ultrasound cleaning action during a one-time sweep over the rubber blanket surface, very high ultrasound energy densities are required on the inked rubber blanket surface, such as are otherwise known from material machining and which can be achieved, for example, by way of welding sonotrodes. Conventional inexpensive sound generators are not capable of providing that required ultrasound performance. They also heat themselves up to a very pronounced extent due to the low degree of efficiency of the conversion of electrical power into effective sound performance, which can lead to the destruction of the sound sources. The previous proposals for improving the washing performance of rubber blanket washing devices with the assistance of ultrasound, therefore have not been able to gain acceptance.

SUMMARY OF THE INVENTION

It is accordingly an object of the invention to provide a washing device, which overcomes the hereinafore-mentioned disadvantages of the heretofore-known devices of this general type, with which washing operations can be shortened considerably and which manages this with an acceptable electrical power input.

With the foregoing and other objects in view there is provided, in accordance with the invention, a washing device, comprising a washing cloth for removing contaminants, ink, etc. from a surface to be cleaned in a cleaning operation, and an ultrasound device for assisting the cleaning operation. The ultrasound device has at least one ultrasound generator and at least one resonator in the form of an oscillating flat metal body outputting sound energy onto a substantially linear region on the surface to be cleaned.

According to the invention, the sound energy which is produced by one or more ultrasound generators is applied by way of a resonator in the form of an oscillating flat metal body to a substantially linear region on the surface to be cleaned. To this end, a sheet metal part made, for example, from stainless steel or titanium is advantageously used, which oscillates in a normal mode of vibration of the oscillating system in the ultrasound range at a frequency of >20 kHz. It is possible for the sheet metal part to be provided with bent away portions and milled portions over the metal sheet length in order to stabilize the normal mode of vibration of the oscillating system and/or to homogenize the normal mode of vibration of the oscillating system. The high sound energy density, which is produced on the surface to be cleaned in the substantially linear region, then releases the ink and/or contaminants from the surface, with the dirt or ink particles being transported away by the damp washing cloth which bears against the surface. In this case, it can be particularly advantageous if the washing cloth moves continuously over the linear region during washing operation, whereas at the same time the part to be cleaned moves at a higher surface speed counter to or in the direction of the washing cloth movement.

Furthermore, it is expedient to use a longitudinal edge of the sheet metal part which is bent away or rounded off, in order to press the washing cloth against the surface to be cleaned. To this end, the sheet metal part is advantageously inclined with respect to the surface normal of the part to be cleaned on the line of contact, to be precise in an angular range from approximately 10° to 70°.

Other features which are considered as characteristic for the invention are set forth in the appended claims.

Although the invention is illustrated and described herein as embodied in a washing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
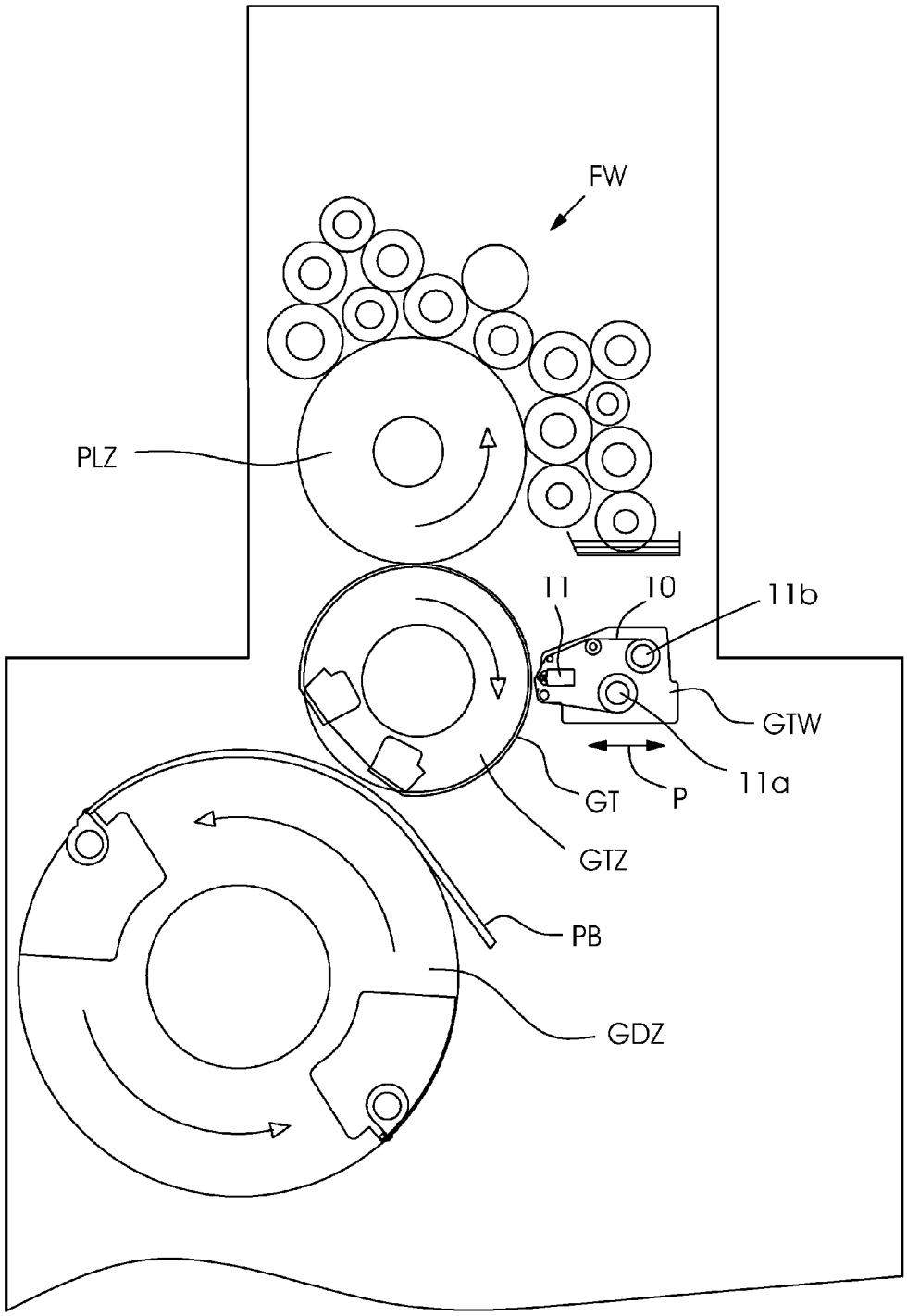
FIG. 1 is a fragmentary, diagrammatic vertical-sectional view of a printing unit of an offset printing press.

Referring now to the figures of the drawings in detail and first, particularly, to FIG. 1 thereof, there is seen a diagrammatic illustration of cylinders in a printing unit of an offset printing press, in a plane which is perpendicular to axes of the cylinders. Reference symbol PLZ denotes a so-called plate cylinder, onto which a printing plate that is inked through non-illustrated rolls of an inking unit FW is fastened through holding devices in a clamping channel. During rotation of the cylinders, a printing image on the printing plate is transferred onto a rubber blanket GT which is clamped on a blanket cylinder GTZ that is shown below. Reference symbol PB denotes a paper sheet which is guided through between the blanket cylinder GTZ and an impression cylinder GDZ and in the process is printed with ink from the rubber blanket GT.

As is customary in offset printing presses, a rubber blanket washing device GTW is provided for washing the rubber blanket GT. The rubber blanket washing device GTW can be set against the blanket cylinder GTZ along an arrow P during a job change after the end of printing operation. The washing device GTW usually includes a washing cloth 10 which is unwound in a cyclically synchronized manner from a first supply reel 11*a* and is wound onto a second receiving reel 11*b*. The washing cloth 10 is pressed, between the reels, against the surface of the rubber blanket GT to be cleaned by a pressure element 11.

Rubber blanket washing devices of this type usually operate in such a way that the cylinder surface to be cleaned rotates past below the washing cloth which is pressed on, and the latter is advanced cyclically in a stepped manner multiple times during one revolution, in order to convey an inked strip-shaped region of the washing cloth further repeatedly in the direction of the receiving reel 11*b*. Furthermore, the washing device includes a drive for moving the washing cloth and a device for feeding washing liquid, if the supply reel 11*a* has not already been impregnated with washing liquid.

Figure 2:
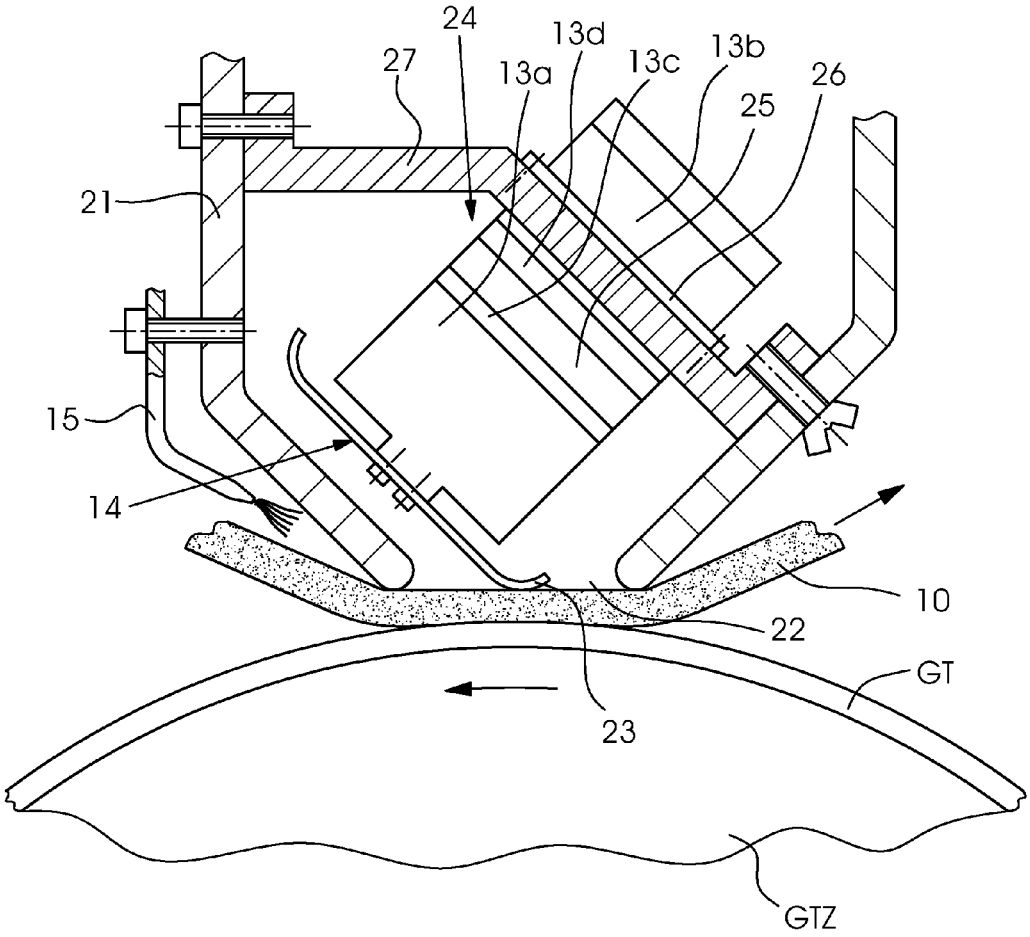
FIG. 2 is an enlarged, fragmentary, vertical-sectional view of a first exemplary embodiment of a pressure element.

FIG. 2 shows a more detailed illustration of a first exemplary embodiment of the modified pressure element 11 according to the invention of the rubber blanket washing device GTW, in a section perpendicular to the cylinder axes.

Figure 4:
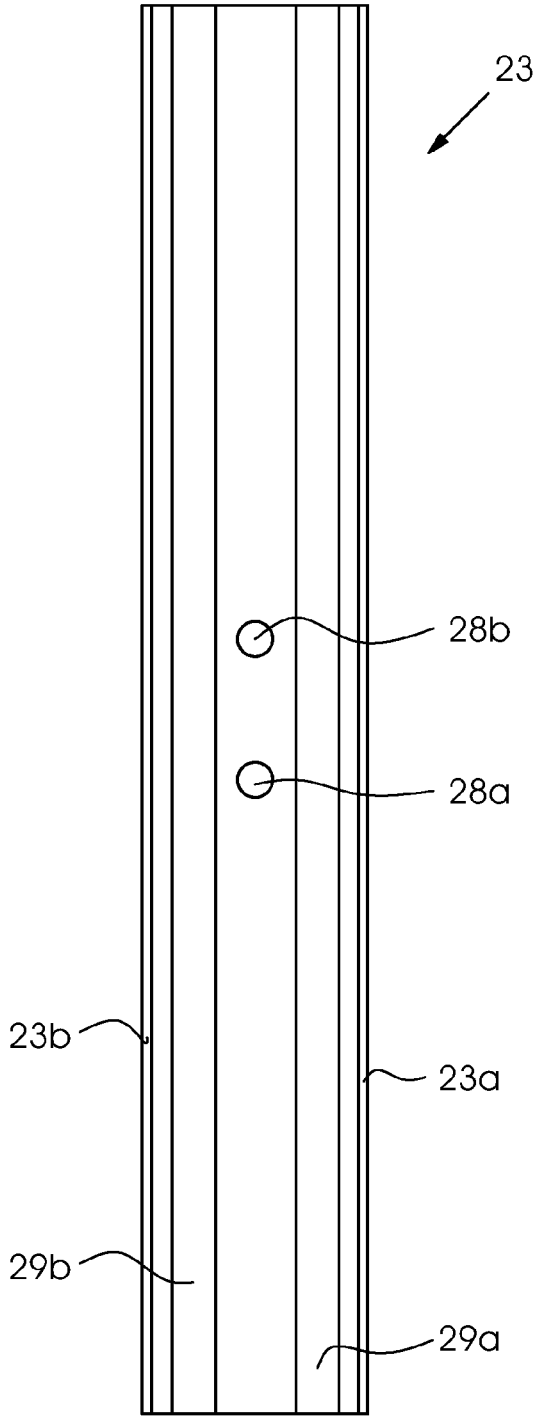
FIGS. 4 and 5 are respective elevational and cross-sectional views of the metal part.
Figure 5:
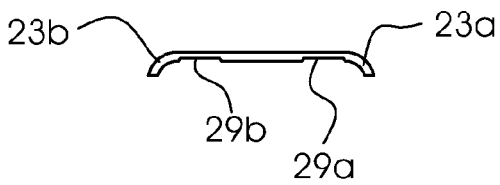
Figure 8:
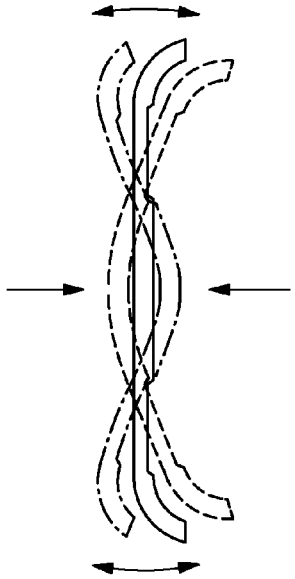
FIG. 8 is an elevational view illustrating oscillation of the metal sheet.

In the exemplary embodiment according to FIG. 2, the pressure element 11 includes a U-shaped aluminum profile 21 which is provided with a longitudinal slot 22 on a side with which it presses the washing cloth 10 against the rubber blanket GT. A flat, elongate metal part 23, having a construction shown in FIGS. 4 and 5, is situated in the interior of the profile 21. The metal part 23 can be excited by an ultrasound oscillator 24 for oscillation in a preferred mode, as will be described in the following text. The ultrasound oscillator 24 includes two cylindrical masses 13*a* and 13*b*, between which two piezoceramic layers 13*c* and 13*d* are disposed in such a way that they are separated by a contact disk 25. The piezoceramic layers 13*c* and 13*d* are each vapor deposited on both sides by way of metal electrodes. The lower cylindrical mass 13*a* of the ultrasound oscillator 24, which faces the washing cloth 10, is fastened centrally on its underside 14 to the metal part 23 through the use of a permanently fixed screw connection and, moreover, is additionally adhesively bonded to the metal part 23. A finished structural unit, including the ultrasound oscillator 24, a clamping flange 26 through which the ultrasound oscillator 24 is fastened in a receiving part 27 of the pressure element 21, and the metal part or "resonator" 23 which is fastened through two screws to the end side of the oscillator 24, is shown in a perspective illustration according to FIG. 3. The metal part 23 itself is shown in FIGS. 4 and 5, both in an elevational view in the direction of the axis of the oscillator 24 (FIG. 4) and in section (FIG. 5). The metal part 23 includes a 2 millimeter thick, 35 millimeter wide and 200 millimeter long metal sheet 123 made from stainless steel, having longitudinal sides 23*a* and 23*b* which are bent over, as can be seen from the illustration. Moreover, two 0.5 millimeter deep and 6 millimeter wide milled out sections 29*a* and 29*b* are made symmetrically with respect to a connecting line between screw holes 28*a* and 28*b*. The bending over of the longitudinal sides 23*a*, 23*b* and the milled out sections 29*a*, 29*b* bring about a situation where the normal mode of vibration of the oscillating system of the metal sheet 123, which acts as a resonator, is formed as uniformly as possible over the entire active width, that is to say the length of the metal sheet 123. It has been shown that, in the case of a corresponding variation of the dimensions and the material of the metal sheet 123, normal modes of vibration of the oscillating system, which have a sufficiently great spacing from neighboring modes, occur in the ultrasound range above 20 kHz, for example at approximately 36 kHz, with the result that, in the case of a central excitation at a corresponding frequency, the metal sheet 123 oscillates resonantly and stably at this frequency, as is shown in simplified form in FIG. 8. The power used for the oscillation of the ultrasound oscillator 24 during washing operation, that is to say when the metal sheet is set against the impregnated washing cloth 10 and also experiences a certain amount of damping as a result, lies at approximately 80 watts in the case of the described active width of 20 centimeters.

Figure 6:
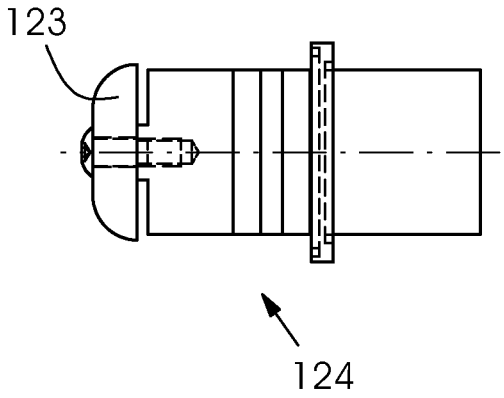
FIGS. 6 and 7 are orthogonal views of an ultrasound generator on a metal sheet.
Figure 7:
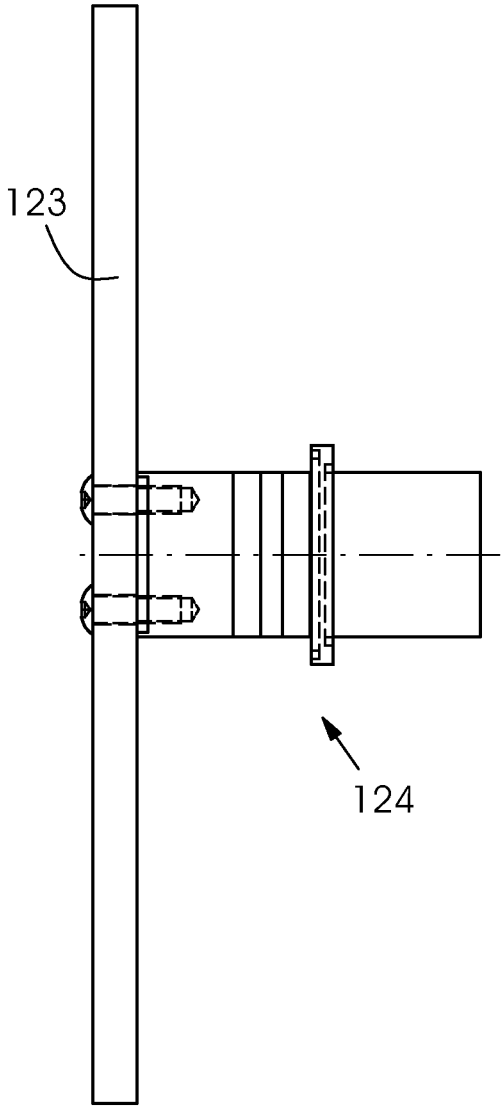

In one preferred exemplary embodiment according to FIGS. 6 and 7, a metal sheet 123 is manufactured from titanium and has a width of 32 mm and a thickness of 8 mm. In contrast to the steel plate in the exemplary embodiment according to FIGS. 3-5, it has no milled-out sections. However, the two end-side edges of the metal body or metal sheet which face the washing cloth are rounded off. The metal sheet 123 has a normal mode of vibration of the oscillating system at 41 kHz. In this refinement, due to the more favorable matter constant of titanium, a greater spacing from adjacent oscillation modes and accordingly a greater stability of the oscillation which is excited by an ultrasound generator 124 in the desired mode can be achieved.

As is shown in FIG. 2, the two rounded off U-shaped limbs of the profile 21 press the washing cloth 10 against the surface of the rubber blanket GT. Small inflow pipes 15 are provided along the profile 21 in order to dampen the washing cloth with washing liquid. As a result of the washing liquid, the ultrasound energy which is emitted by the oscillating metal part 23 or sheet 123 at the line of contact with the washing cloth 10 is guided effectively onto the surface of the rubber blanket GT and can release dirt and ink residues there which adhere to the rubber blanket surface, due to cavitation of gas bubbles which are produced in the liquid.

Of course, it is also possible, instead of a single metal part 23, to place a plurality of individual metal parts and respectively associated ultrasound oscillators in the profile 21.

Figure 9:
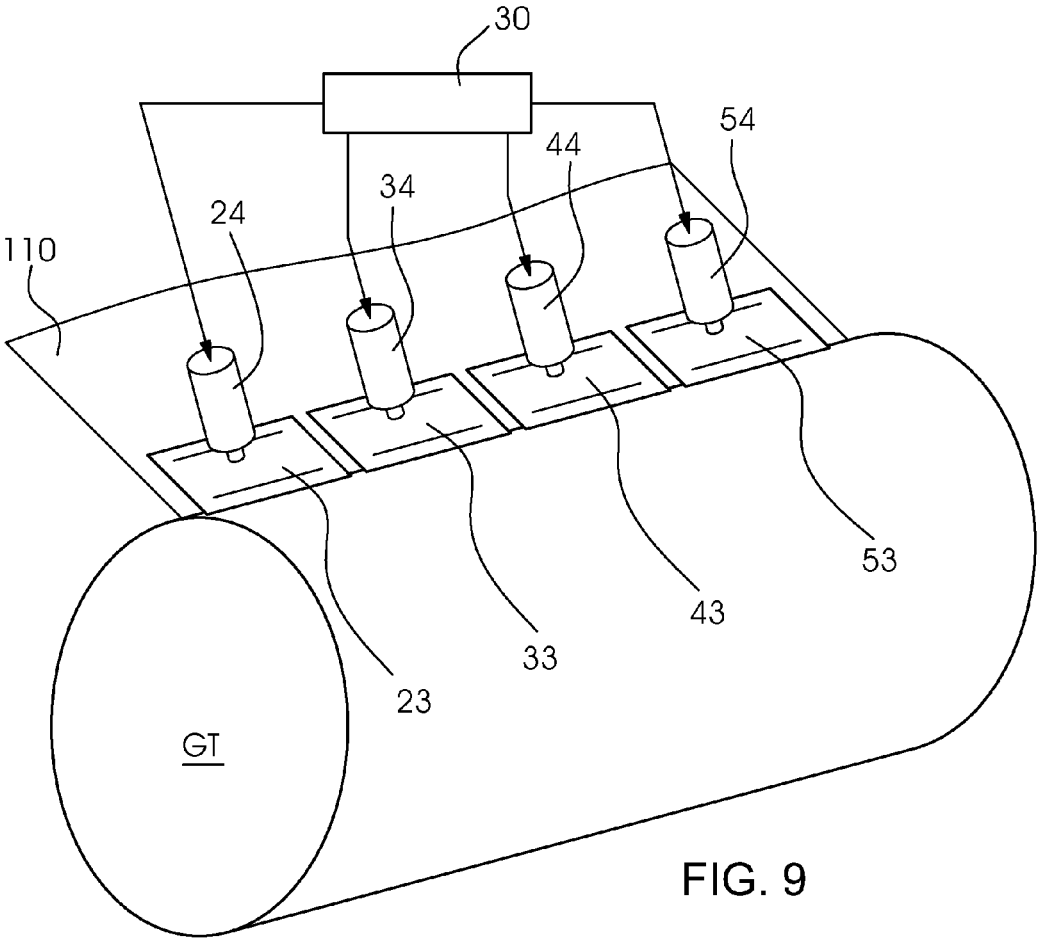
FIG. 9 is a perspective view of a rubber blanket having metal parts, bodies or resonators with ultrasound generators.

It can be expedient for manufacturing reasons to provide washing devices for printing press types having different format widths and/or cylinder lengths, in which the washing devices include a plurality of ultrasound devices having identical dimensions, that is to say, for example, two for the 52 format, three for the 74 format, four for the 105 format, etc. This case is shown in FIG. 9. There, reference numeral 110 denotes a washing cloth which is pulled over the blanket cylinder GZ of the printing press. In a linear region, in which the washing cloth 110 is pressed onto the rubber blanket GT, which is clamped onto the surface of the blanket cylinder, four homogeneous ultrasound devices, as shown in FIGS. 2 to 5 or 6 to 7, are disposed next to one another. A spacing between stainless steel plates 23, 33, 43, 53 which act as resonators is approximately 0.3 millimeters. It has been shown that a small spacing between the "resonators" does not have a negative influence on the washing result, and that stripes which could be eliminated by a displacement of the washing device as a result of a second washing cycle or a superimposition of the "resonators," are not formed during washing. The resonators 23, 33, 43, 53 may be disposed along a straight line or staggered. For example, the first and third resonators may be disposed slightly in front of the second and fourth resonators in such a way that the resonators overlap slightly in order to avoid any stripes which would otherwise be visible the direction of movement of the cylinder surface after cleaning.

Figure 3:
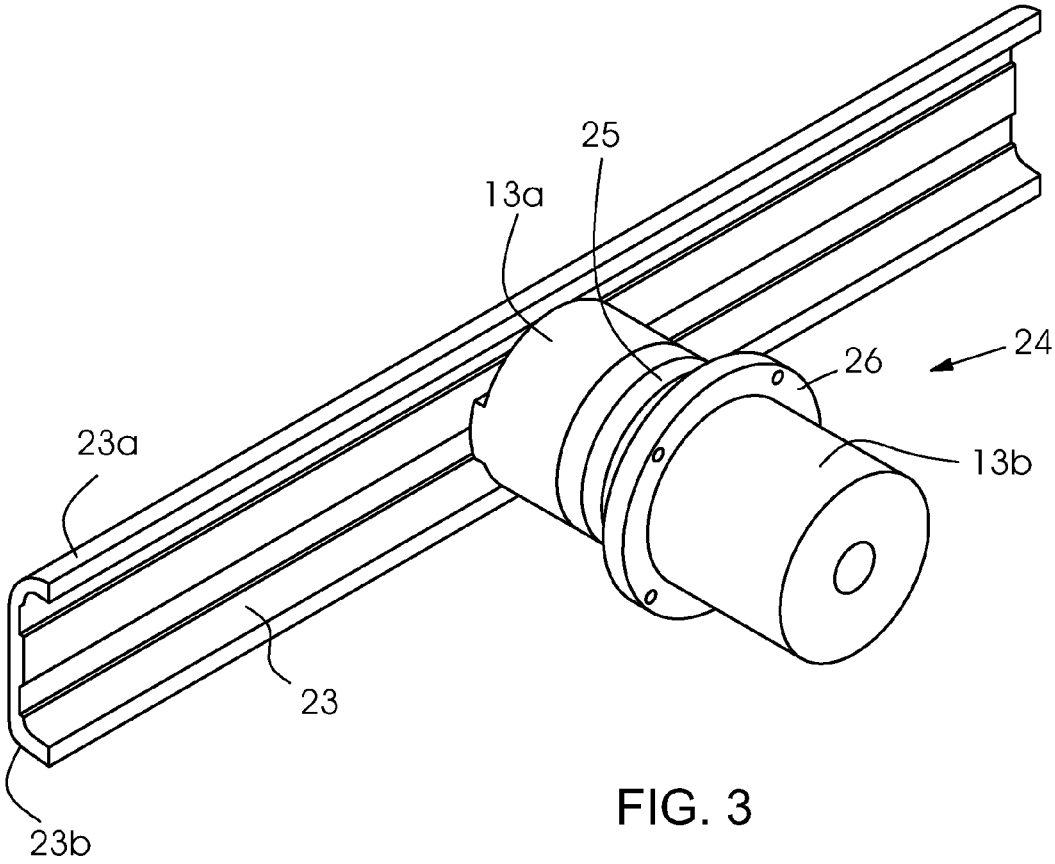
FIG. 3 is a perspective view of a finished structural unit having a metal part and an ultrasonic generator.

The four ultrasound oscillators, by way of which the "resonators" are excited, are connected to a common resonance amplifier 30, which is tuned to the frequency of the "resonators." Slight production-induced tolerances in the natural frequencies of the resonator plates (23, 33, 43, 53) can also still be compensated for retrospectively by slight grinding or turning of the cylindrical masses (13*a* and 13*b*, see FIGS. 2 and 3). In this way, the natural frequencies of the oscillating systems including the ultrasound generators 24, 34, 44, 54 and the associated resonator plates 23, 33, 43, 53 are tuned to the same value. However, this frequency tuning can also be performed in a different way. In an alternative, non-illustrated exemplary embodiment, the resonance amplifier has four channels, the frequencies of which can be tuned separately. Corresponding switching configurations, which are known per se in the resonance amplifier, achieve a situation where the frequency of the generated oscillation of the four channels of the resonance amplifier is adapted automatically to the natural frequencies of the four resonator plates 23, 33, 43, 53.

The present invention has been described by using one exemplary embodiment, in which a rubber blanket (GT) that is clamped onto the blanket cylinder (GTZ) of a printing press is cleaned. However, it can also be used for cleaning not only cylindrical surfaces in other machines, appliances or systems. Rather, it can also be used to clean flat surfaces, in which a relative movement between the washing device and the surface to be cleaned is then brought about through a suitable drive.

The invention claimed is:

1. A washing device for removing contaminants and ink from a surface to be cleaned, comprising:

an ultrasound device having at least one ultrasound generator and at least one resonator being an oscillating flat and substantially rectangular sheet metal body;

a washing cloth having an inner surface and an outer surface, said inner surface contacting a bent away or rounded off portion of said resonator, such that in use, said washing cloth is positioned between said resonator and the surface to be cleaned; and said resonator being configured for pressing said washing cloth against the surface to be cleaned and outputting sound energy onto a substantially linear region on the surface to be cleaned when excited in the ultrasound range for producing oscillations, in a normal mode of vibration of an oscillating system extending substantially over a length of said metal body and having an oscillation direction being inclined at an angle between 10° and 70° relative to a surface normal of the surface to be cleaned in a line of contact of said washing cloth.

2. The washing device according to claim 1, wherein said at least one resonator of said ultrasound device is a plurality of individual resonators.

3. The washing device according to claim 2, wherein said individual resonators are disposed along a straight line or staggered.

4. The washing device according to claim 1, wherein said sheet metal part is formed of stainless steel, titanium or aluminum.

5. The washing device according to claim 1, wherein said metal body has two longitudinal edges, at least one of said longitudinal edges is at least one of bent away or rounded off or has at least one depression formed therein extending along said metal body.

6. The washing device according to claim 1, wherein said oscillating metal body has an excited natural frequency of greater than 20 kHz.

7. The washing device according to claim 1, wherein said normal mode of vibration of said excited oscillating system of said metal body is as far away from adjacent oscillation modes as possible.

8. The washing device according to claim 1, wherein said metal body is formed of an approximately 2 mm thick and 35 mm wide stainless steel strip having a natural oscillation frequency.

9. The washing device according to claim 8, wherein said natural oscillation frequency lies between 35 and 37 kHz.

10. The washing device according to claim 1, wherein said metal body is formed of an approximately 8 mm thick and 32 mm wide titanium sheet having a natural oscillation frequency.

11. The washing device according to claim 8, wherein said natural oscillation frequency lies between 40and 43 kHz.

12. The washing device according to claim 1, wherein the surface to be cleaned is a surface of a cylinder having an axis, and said metal body has at least one longitudinal side extending parallel to the axis of the cylinder and being excited by said at least one ultrasound generator in the oscillation direction.

13. The washing device according to claim 1, wherein said metal body is at least one of welded, screwed or adhesively bonded to a part of said at least one ultrasound generator.

14. The washing device according to claim 1, wherein said metal body and a part of said at least one ultrasound generator are manufactured in one piece.

15. The washing device according to claim 2, wherein said at least one ultrasound generator is a plurality of ultrasound generators, each of said plurality of resonators is connected to a respective one of said plurality of ultrasound generators, and a resonance amplifier supplies said resonators in common with alternating voltage.

16. The washing device according to claim 2, wherein said at least one ultrasound generator is a plurality of ultrasound generators, each of said plurality of resonators is connected to a respective one of said plurality of ultrasound generators, and a dedicated resonance amplifier or a dedicated channel of a multi-channel resonance amplifier supplies each of said resonators with alternating voltage.

17. The washing device according to claim 1, wherein the surface to be cleaned is a rubber blanket clamped on a cylinder in a printing press.

18. A washing device for removing contaminants and ink from a surface to be cleaned, comprising:

an ultrasound device having at least one ultrasound generator and at least one resonator being an oscillating flat and substantially rectangular sheet metal body;

a washing cloth having an inner surface and an outer surface, said inner surface contacting a bent away or rounded off longitudinal edge of said resonator, such that in use, said washing cloth is positioned between said resonator and the surface to be cleaned; and said resonator being configured for pressing said washing cloth against the surface to be cleaned, said sheet metal body being inclined relative to a surface normal of the surface to be cleaned and outputting sound energy onto a substantially linear region on the surface to be cleaned when excited in the ultrasound range for producing oscillations.

19. The washing device according to claim 18, further comprising a U-shaped profile having a longitudinal slot, said sheet metal body being disposed in an interior of said U-shaped profile and said longitudinal edge contacting said washing cloth through said slot.

* * * * *